United States Patent [19]

Felbinger

[11] 4,351,016

[45] Sep. 21, 1982

[54] DEVICE FOR ARRESTING THE MOTION OF A MOTOR DRIVEN PANEL

[75] Inventor: Willy Felbinger, Altdorf, Fed. Rep. of Germany

[73] Assignee: Saint Gobain Vitrage, Aubervilliers, France

[21] Appl. No.: 192,889

[22] Filed: Oct. 1, 1980

[30] Foreign Application Priority Data

Oct. 2, 1979 [DE] Fed. Rep. of Germany ..... 2939942

[51] Int. Cl.[3] ..... H01H 47/12; E05F 15/02

[52] U.S. Cl. ..... 361/181; 49/27; 49/28; 318/266; 318/286; 318/466

[58] Field of Search ..... 361/181; 49/27, 26, 49/28; 318/266, 286, 466

[56] References Cited

U.S. PATENT DOCUMENTS 3,624,473 11/1971 Robbins ..... 318/266
3,651,389 3/1972 Ito et al. ..... 318/266
3,764,861 10/1973 Orris ..... 361/181
3,815,005 6/1974 Berger ..... 318/286 X

FOREIGN PATENT DOCUMENTS 1334228 10/1973 United Kingdom .
1355657 6/1974 United Kingdom .
2013428 8/1979 United Kingdom .

*Primary Examiner*—Reinhard J. Eisenzopf
*Attorney, Agent, or Firm*—Pennie & Edmonds

[57] ABSTRACT

Apparatus is disclosed for arresting the motion of a motor driven panel wherein an electrical conductor along an exposed edge of the panel is connected to an electrical sensing circuit. The presence of an object in contact with the electrical conductor is sensed by the sensing circuit, which then operates a switching device. The switching device disconnects drive power to the motor, preventing motion of the panel for as long as the object is in contact with the electrical conductor.

14 Claims, 6 Drawing Figures

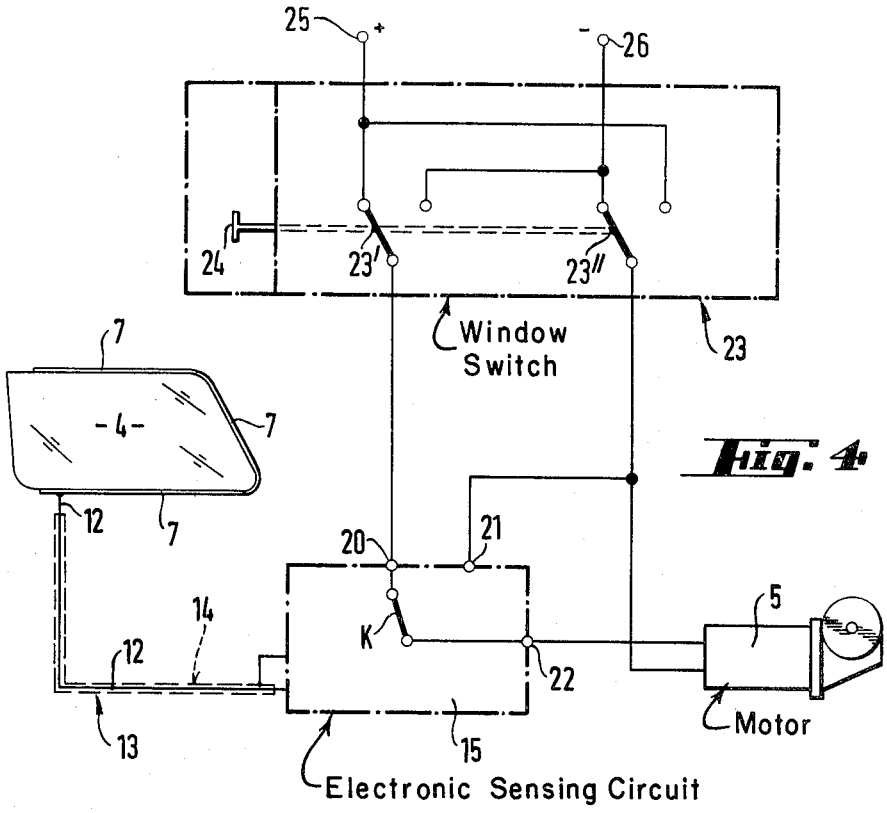
Fig. 4
Fig. 5
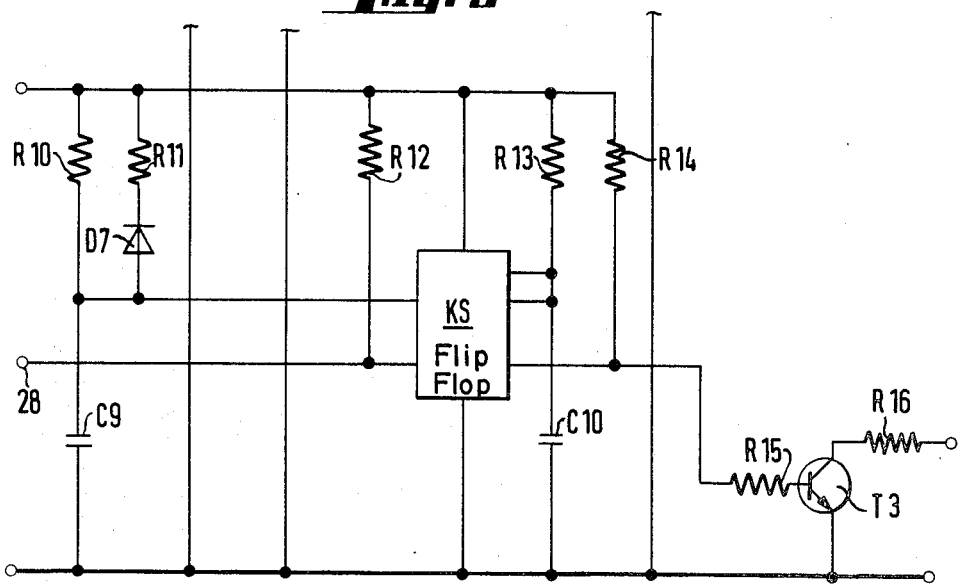

DEVICE FOR ARRESTING THE MOTION OF A MOTOR DRIVEN PANEL

TECHNICAL FIELD

This invention relates to a device which switches off a drive unit, such as a motor, driving a moving panel. Illustratively, the panel is a component such as a door, window or sliding roof in an automobile; and the drive unit is a motor. The invention is particularly useful as a safety shut-off device to prevent injuries to a part of the body which may be caught between the sliding panel and a frame in which it moves. Other applications, however, will be apparent.

BACKGROUND ART

A shut-off device for a window raising motor is described in German disclosure document DE-AS No. 12 10 690. That device eliminates limit switches for the drive motor. Another purpose of that device is to switch off the window raising motor when the user carelessly places his hand on the edge of the window pane. When a force is exerted on the window pane, the motor develops an increased torque and draws an increased current. The motor is shut off by sensing this increase in torque. A safety relay is provided for switching off the drive motor in case of overload. This safety relay establishes a connection between the actuating relays provided for each direction of rotation of the motor, which connection causes both relays to pull in to stop the drive motor, regardless of the contact position of a manual switch for operating the motor.

German disclosure document DE-AS No. 21 63 746 describes an electromechanical device to prevent pinching. One of the purposes of that design is to eliminate the disadvantage of contact strips arranged in pairs, which form a closed circuit when they touch each other. Such contact strips may be deformed if exposed to certain forces, and then form a permanent short circuit. As set forth in that disclosure, a rope is provided in an elastic rubber gasket; and the rope is used to operate a switch. However, this device is a complicated mechanism that is subject to failure; and it cannot be used for automobile windows.

Alternatively, a device has been proposed which limits the closing force of the window pane to a maximum value, while using a substantially greater force to open the window. See German disclosure document DE-AS No. 15 30 992. In that design the speed-torque characteristic of a motor is reduced appropriately by means of a third brush when the motor turns in the direction which closes the window. Further reductions of the torque exerted in closing the window are, however, not permissible due to the requirement that the window raising motor must securely close the window even if component wear causing increased friction occurs with the progress of time. For stricter requirements a separate motor would be required.

Mechanical devices for controlling the torque of a window raising motor are disclosed, for example, in German disclosure documents DE-OS Nos. 18 01 339, 19 31 169 and 20 28 195. According to DE-OS No. 19 31 169 a slip clutch can be made ineffective by means of a bridging jumper switched on by an additional manual switch. According to DE-OS No. 20 28 195 the bridging jumper is disconnected when the motor turns in the direction which causes the window to open.

Electric eyes are proposed for monitoring the doors of vehicles according to German disclosure document DE-OS No. 15 80 284. The requirements for the automatic operation of doors, however, are quite different from those for the operation of automobile windows.

DISCLOSURE OF THE INVENTION

To overcome the difficulties of the prior art, an apparatus has been devised for arresting the motion of a motor driven panel whenever, and for as long as, an object is in contact with an exposed edge of said panel. In accordance with the invention, an electrical conductor is provided along the leading edge of the panel, for example, along the edge of a window which borders the window opening in an automobile door frame. This conductor is connected to an electric sensing circuit which switches off the drive unit as soon as the conductor makes contact with an object, such as a human body.

As a result of this arrangement it is not necessary to use one motor torque to open the window and a lower torque to close it. Nor is there any increase in motor torque when movement is arrested. Thus the apparatus offers a window drive which is safe even if the window jams and it provides a reliable protection against pinching.

In a preferred embodiment of the invention, the electrical conductor is connected to the output of an oscillator circuit which is in turn connected to a sensing circuit and an amplifier stage. If the conductor makes contact with a body it dampens the amplitude of the oscillations of the oscillator. The sensing circuit reacts to the dampening and switches off the motor through a disconnect means responsive to the output of the amplifier stage.

Another advantage of the invention is that special switches which are actuated in the closed and possibly in the open position of the window are generally not necessary. This is the case because the electronic sensing circuit is also activated when the conductor makes contact with the frame of the window. Due to this arrangement the motor-driven window pane does not exert any force on the frame which could distort the frame.

The invention is not restricted to window raising motors. It can also be used for sliding door or sliding-roof drives. It can, in addition, be used as a safety device for automatically closing elevator doors. Other applications will be apparent to those skilled in the art.

BRIEF DESCRIPTION OF THE DRAWINGS

Additional features and advantages of the invention may be readily ascertained by reference to the following description and appended drawings in which:

FIG. 4 is a wiring diagram of the circuit of FIG. 3, showing its connection to a drive motor and a switch;

FIG. 5 is a supplemental circuit diagram for the electronic sensing circuit of FIG. 3.

BEST MODE FOR CARRYING OUT THE INVENTION

Figure 1:
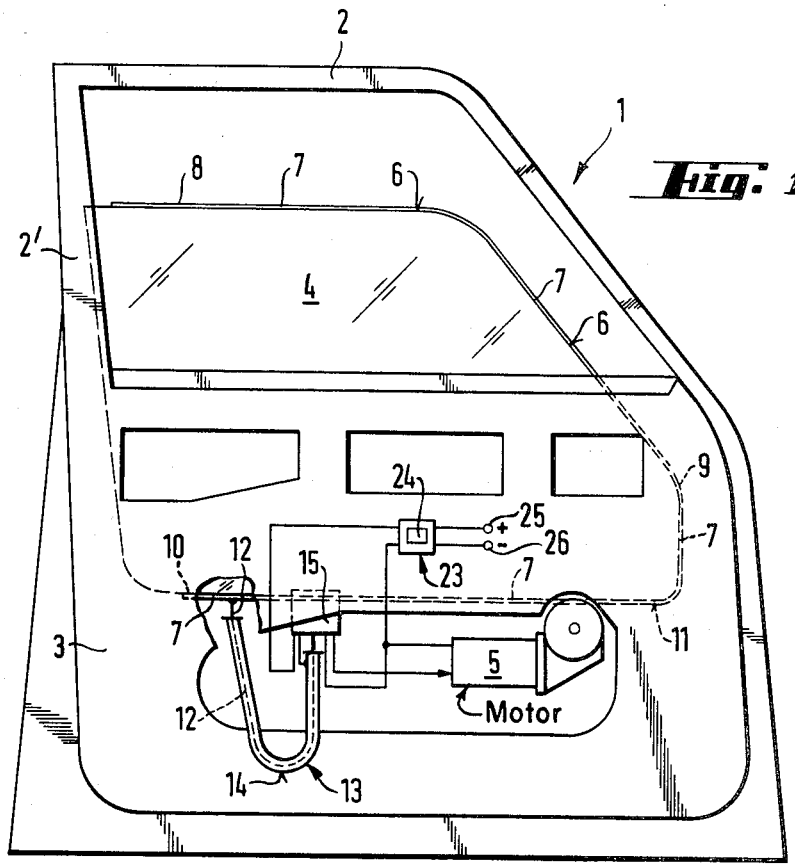
FIG. 1 is a schematic representation of an automobile door.

Referring to FIG. 1, an automobile door 1 comprises a window frame 2 and a door structure 3. Guides, not shown in detail, for window pane 4 are provided in door structure 3. A motor 5, for actuating window pane 4, is provided in door structure 3. Motor 5 drives window pane 4 through a linkage, not shown, acting on the lower edge of window pane 4.

A portion of the edge area 6 of window pane 4 is covered with an electrical conductor 7. This conductor should extend along substantially all of the leading edge of the window. Thus, with reference to the door shown in FIG. 1, conductor 7 should extend at least approximately from point 8 to point 9 so as to encompass substantially all of the edge which is moved into and out of contact with window frame 2. In the embodiment shown, electrical conductor 7 at the edge of window pane 4 preferably extends continuously from point 8 to point 10. Electrical conductor 7 may, for example, be a wire or strip glued to the edge of window pane 4. Electrical conductor 7 can also be a metallic coating of the edge of window pane 4.

Point 8 is at a distance from a window guide 2', so that there is no electric contact between guide 2' and electrical conductor 7. Where window pane 4 enters door structure 3, rubber sealing strips are provided. These strips are not in contact with electrical conductor 7 because conductor 7 is attached only to the edge of window pane 4. If electrical conductor 7 also extends to the area close to a guide for window panel 4, the guide must be insulated or shielded from electrical conductor 7.

A center conductor 12 of a coaxial cable 13 is connected to electrical conductor 7 at a point on lower edge 11 of window panel 4. External conductor 14 of cable 13 lies in the open within door structure 3. Coaxial cable 13 is connected to an electronic sensing circuit 15 which is part of the electronic control circuit of motor 5.

Figure 2:
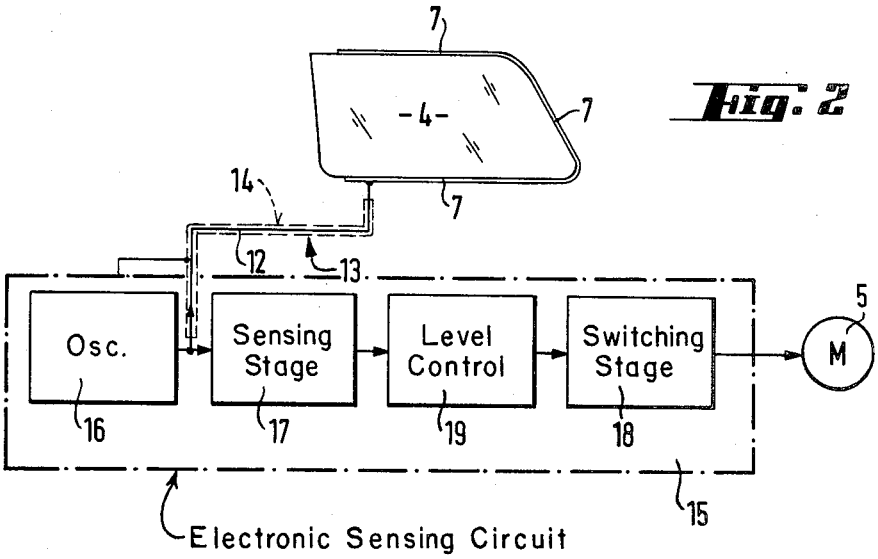
FIG. 2 is a block diagram of an electric circuit, which senses an object and controls power to a drive motor.

As shown in the block diagram of FIG. 2, electronic sensing circuit 15 comprises an oscillator 16, a sensing stage 17, a switching stage 18 and, optionally, a level control stage 19. The output of oscillator stage 16 is connected to electrical conductor 7, through coaxial cable 13, as well as to sensing stage 17. Oscillator 16 supplies to electric conductor 7 a signal with a frequency in the kilohertz range, for example, 200 kHz. Electrical conductor 7 thus acts as a transmitting antenna. Oscillator 16 is designed so that an object making contact with electrical conductor 7 dampens the amplitude of the oscillator 16. Such dampening takes place when a low-resistance object makes contact with electrical conductor 7, or in cases where the conductivity of the object is low, when the capacity or mass of the object is large.

The dampening of the oscillations of the oscillator is immediately sensed by sensing stage 17 which transmits a switching signal to switching stage 18 which in turn switches off the motor. If necessary, a level control stage 19 is provided between sensing stage 17 and stage 18.

Figure 3:
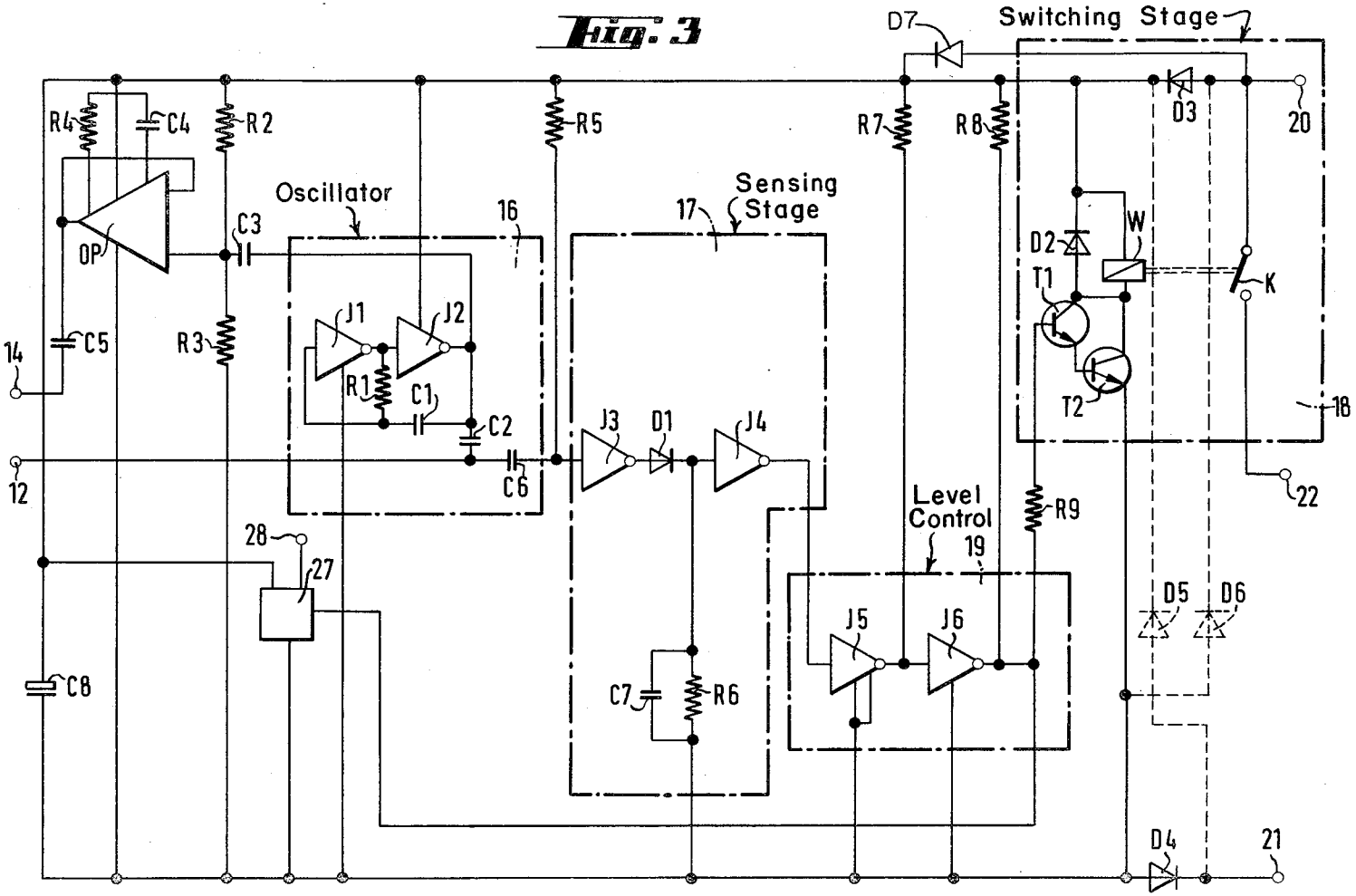
FIG. 3 is a circuit diagram of the block diagram of FIG. 2.

Referring to FIG. 3, oscillator 16 is formed by two inverters I1, I2, connected in series, and a resistor R1 and a capacitor C1 which determine the frequency of the oscillator. The output of inverter I2 is fed back to the input of inverter I1 through capacitor C1. Resistor R1 lies between a point connected to the input of inverter I2 and the output of inverter I1 and capacitor C1. The oscillator output is connected to the center conductor 12, of coaxial cable 13 of FIG. 1, and thus to electric conductor 7, by means of coupling capacitor C2. The oscillator output is also connected through coupling capacitor C3 to impedance transformer, or voltage follower, OP. A voltage divider consisting of resistors R2 and R3 is provided to establish the operating point of impedance transformer OP. For purposes of frequency compensation, a series circuit consisting of a resistor R4 and a capacitor C4 is connected to impedance transformer OP. The output of impedance transformer OP is connected to the external conductor 14 of coaxial cable 13 through coupling capacitor C5. By virtue of this arrangement the same high-frequency signal is fed to center conductor 12 and external conductor 14; but the signal fed to center conductor 12 is a high impedance signal while that fed to external conductor 14 is a low impedance signal. Center conductor 12 and consequently electric conductor 7 are sensitive to dampening. In addition, the phase of both high-frequency signals is identical. The actual capacity of coaxial cable 13 is thus compensated, because no difference in electric potential exists at any time between external conductor 14 and center conductor 12. This compensation of the capacity of cable 13 makes it possible to use the same electrical circuit with coaxial cables which differ in length depending on the design of door 1. Another advantage of this compensation is that changes in the position of coaxial cable 13 as window pane 4 moves have little effect on the amplitude of oscillations on conductor 7.

Center conductor 12, and consequently the output of oscillator stage 16, are connected to sensing stage 17 through a coupling capacitor C6. Sensing stage 17 comprises two inverter stages I3 and I4. A resistor R5 is used to set the operating point of inverter I3. A rectifier diode D1 is provided between the two inverters I3 and I4. In addition, a capacitor C7 and a resistor R6 are connected in parallel to the input of inverter I4. When the oscillation on conductor 7 is not dampened, capacitor C7 is charged, producing a logic signal H (logic high) at the input to inverter I4 and a logic signal L (logic low) at the output of inverter I4. As soon and as long as contact is made with electric conductor 7 and the oscillation is thus dampened, a logic high signal is applied to the input of inverter I3 through resistor R5. Correspondingly, there appears at the output of inverter I3 a logic low signal. Because the logic signal at the output of inverter I3 is blocked by diode D1, previously charged capacitor C7 discharges through resistor R6, so that the logic signal at the input of inverter I4 goes low and a logic signal high is generated at the output of inverter I4.

Inverter stages I1 to I4 can be formed by one single integrated circuit, for example, integrated circuit HCF 4069 manufactured by Signetics.

CMOS circuits are suitable for the circuit components described above. Such components can be operated with supply voltages varying within wide limits which is advantageous for operation from the electrical system of an automobile. It is, however, not possible to switch large outputs by using CMOS components. Therefore an output level adapter stage 19 is provided, which can, for example, be based on a TTL integrated circuit. This circuit comprises two inverter stages I5 and I6 which are, for instance, available from Texas Instruments in integrated circuit SN 75 491. Resistors R7 and R8 are provided for setting the operating point of inverter I6 and transistor T1. The inverter I6 is connected to the Darlington-Switching-Stage through a coupling resistor R9. The Darlington-Switching-Stage is formed by two transistors T1 and T2. Coil W of a relay is connected in series with the collector and emitter of transistor T2. Contact K of the relay is normally closed but is open when a current flows through coil W. Protective diode D2 is connected in parallel with coil W. This circuit is connected through diode D3 which protects against change of polarity, to pole 20 of the electrical system of the automobile. The other terminal of the circuit is connected through diode D4 to the other pole 21 of the electrical system of the automobile. Pole 20 is also connected to one terminal 22 of motor 5 through relay contact K.

If the oscillations of the oscillator are dampened, transistors T1 and T2 are switched to the conducting mode by the logic high signal of the output level adapter stage 19. The resulting current through coil W opens relay contact K, cutting off motor 5.

When window 4 is being closed, diode D4 increases the potential applied to the negative side of sensing circuit 15 by approximately 0.7 volts, because the forward voltage drop of diode D4 is approximately 0.7 volts. If, because of extreme humidity, a water bridge is formed between electrical conductor 7 and window frame 2, in particular at the rubber gasket, this bridge will, as a result of the above arrangement, not cause a permanent switching off of motor 5.

Filtering capacitor C8 can be provided between diodes D3 and D4 for filtering out disturbing alternating voltage components. The circuit which has been described cannot cause radio interferences in the area around electrical conductor 7, as the "transmitting output" of conductor 7, which forms an antenna, is considerably below the interference noise level of the engine of the vehicle in which the circuit is installed. Moreover, the circuit is only in operation when the ignition of the vehicle is "ON", and when the window is moved, as described below.

FIG. 4 shows the electrical connection of motor 5 to positive pole 25 and negative pole 26 of the electrical system of the vehicle, through electronic sensing circuit 15 and a conventional window switch 23. Window switch 23 comprises an operating button 24 and two double-throw switches 23' and 23", that is, a double pole double throw switch with a center off position. In the switch position shown in FIG. 4, both switch contacts, 23' and 23", are in a position that causes motor 5 to raise window pane 4. As soon as electric conductor 7 makes contact with an object, relay contact K opens, so that motor 5 stops and no further closing motion of window pane 4 occurs.

Relay contact K will open at the latest when window pane 4 moves into the closed position and makes contact with the frame.

When window switch 23 is returned to its "off" position, no voltage is applied to poles 20, 21 and switch K returns to its closed position. In order to open the window, actuating button 24 is pressed. If this is done, the two switch contacts 23' and 23" change position so that contact 23' is connected to the negative pole 26 and switch contact 23" to the positive pole 25 of the battery. A negative potential is then applied to pole 20 of electronic sensing circuit 15, so that diode D7 is in the nonconductive mode. Diode D4 becomes nonconductive, too, as a positive potential is applied to pole 21. A supply voltage for the electronic sensing circuit 15 is thus lacking, with the result that oscillator stage 16 does not oscillate and electric conductor 7 and the other circuit components are inoperative. Relay contact K then remains closed. The reversed supply voltage polarity to motor 5 is supplied through relay contact K and switching contacts 23' and 23", so that window pane 4 moves in the direction which opens the window. While the window pane 4 is opening, it is not necessary to provide for a means for switching off the motor independently of the operation of the actuating button 24, as there is no pinching danger when the window opens.

FIG. 3 also shows supplemental diodes D5 and D6 and supplemental circuit 27. Supplemental circuit 27 is advantageously placed in parallel to filtering capacitor C8. Diodes D5 and D6 are used together with supplemental circuit 27 to assure that motor 5 is switched off as a result of a contact with electrical conductor 7 when window pane 4 has been moved to its fully open position. A particular advantage of this feature is the elimination of the expensive dampening means conventially used for the window pane or its drive. The supplemental circuit also ensures that motor will be turned on when window switch 23 is activated even if the window pane is in its fully open or fully closed position where conductor 7 contacts electric contact 30 or window frame 2.

Supplemental circuit 27 comprises a monostable flip-flop, or monostable multivibrator, KS which may, for example, be formed by an integrated circuit such as NE 555 which, is sold by Texas Instruments. The control input of flip-flop KS is connected to a tap of a resistor R10 and a capacitor C9, connected in series. As soon as a voltage is applied to sensing circuit 15 by window switch 23, a voltage is applied to a series circuit comprising elements R10, C9, either through diodes D3 and D4 or through diodes D5 and D6, depending on the direction in which the actuating button 24 is moved. This transmits, at the instant when the contacts of window switch 23 are closed, a starting pulse to flip-flop KS through capacitor C9. This starting pulse switches an output of flip-flop KS to which the base of a transistor T3 is connected through a resistor R15. This puts transistor T3 into the conductive mode. Through a resistor R16 transistor T3 is connected to the series resistor R9 connected to the base of transistor T1. The Darlington stage consisting of transistors T1 and T2 is put into the nonconductive mode, so that relay coil W cannot open contact K, regardless of whether center conductor 12 or electric conductor 7 dampens the oscillations of oscillator 16.

The period during which transistor T3 is put in the conductive mode by flip-flop KS and electric conductor 7 is therefore made ineffective is determined by a resistor R13 and capacitor C10, connected to flip-flop KS. Resistor R13 and a capacitor C10 are chosen so that the pulse which puts transistor T3 into the conductive mode has a duration on the order of, for example, 0.5 sec.

Resistors R12 and R14 are used to generate the required bias voltage. A series circuit consisting of diode D7 and a resistor R11 is connected in parallel to resistor R10. Resistor R11 is considerably smaller than resistor R10. As soon as no voltage is applied to the circuit, capacitor C9 is discharged through diode D7 and resistor R11.

Figure 6:
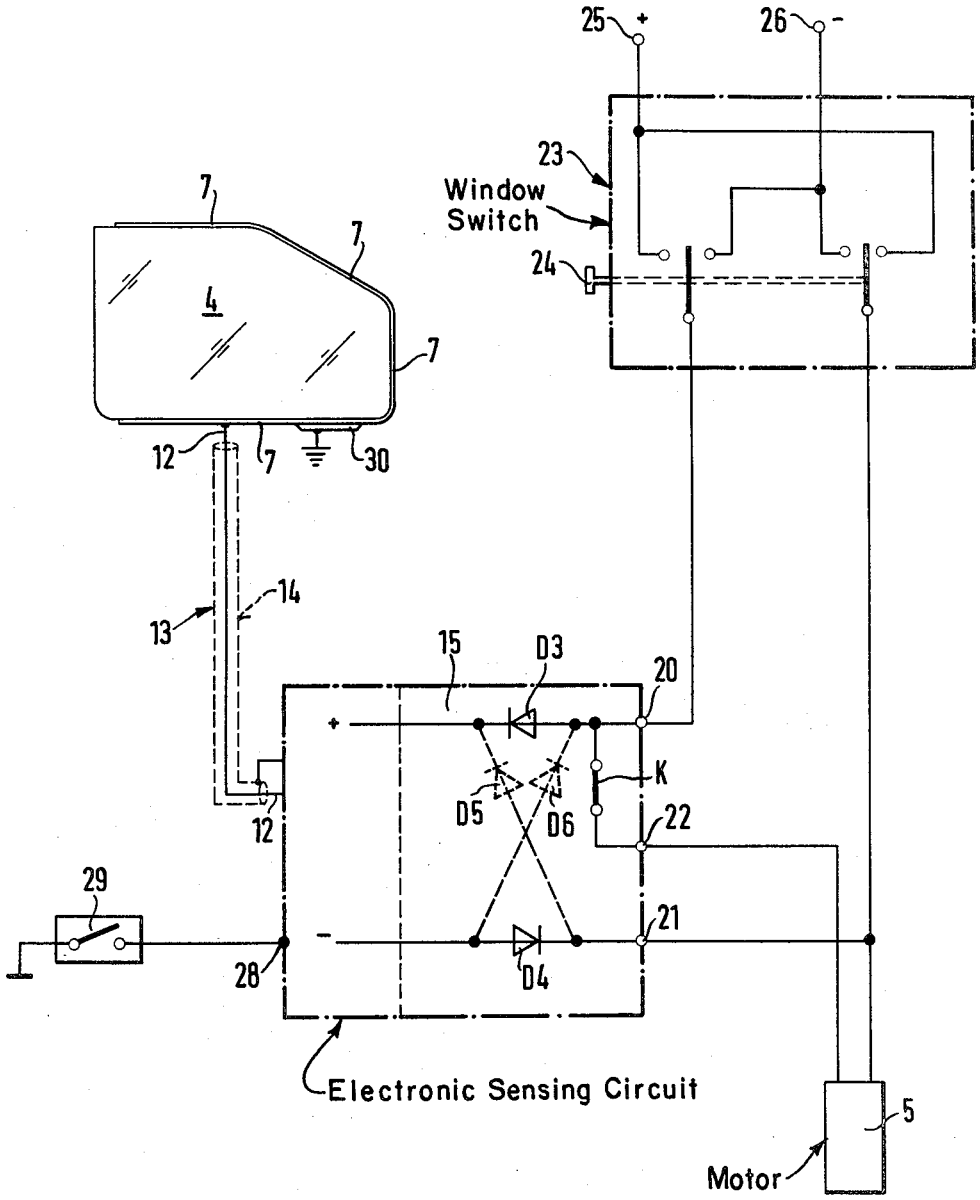
FIG. 6 is a wiring diagram for a circuit incorporating the supplemental circuit of FIG. 5.

At least one switch 29 (see FIG. 6) is connected to a reset terminal 28 of flip-flop KS and the other terminal of said switch is connected to the chassis of the vehicle or one of the poles 25, 26. As shown in FIG. 6, electric contact 30, for example, a strip of sheet metal attached to the chassis, is mounted so that electric conductor 7 contacts it when window pane 4 is the fully open position.

The supplemental circuit described above functions approximately as follows:

If it is desired to close window pane 4 from the completely open position shown in FIG. 6, actuating switch 24 is operated to apply the battery voltage circuit 15. As the oscillation of the oscillator is dampened through contact 30 when window pane 4 is in the open position, this alone would cause switch contact K to be open, so that motor 5 would not be able to start. However, at the instant when the contacts of window switch 23 are closed, the Darlington stage T1, T2 is put in the nonconductive mode through flip-flop KS and transistor T3 so that contact K remains closed and motor 5 starts. The time, for example, 0.5 sec., during which flip-flop KS and transistor T3 force Darlington stage T1, T2 to remain nonconductive, has been chosen in such a manner that window pane 4 and its conductor 7 are certain to leave contact 30 during that time. After the above time the oscillator circuit operates in such a manner that any touching of electric conductor 7 results in the immediate switching-off of the motor. When the window reaches the fully closed position, conductor 7 contacts frame 2 thereby dampening the oscillations of oscillator 16 and causing switch K to open and shut off motor 5.

The same applies when the window pane is to be opened starting from its closed position. In this case, too, the contact between the top edge of window frame 2 and the electric conductor 7 which would normally dampen the oscillator is at first made ineffective by flip-flop circuit KS. When the window reaches its fully open position conductor 7 contacts electrical contact 30, thereby dampening the oscillations of oscillator 16 and causing switch K to open and shut off motor 5.

If we assume that the window pane is partly closed and that between the top of the window frame and edge 6 there exists a gap which is just wide enough for a body part to be inserted, there exists in theory, the danger that within the time period mentioned above of, for example, 0.5 sec. in which electronic conductor 7 is made ineffective, the window pane will move far enough that painful pinching of a body part cannot be excluded.

In order to eliminate this danger, too, switch 29 actuable by window pane 4 is provided. As soon as window pane 4 has moved from its fully open or, if it applies, from its fully closed position, switch 29 closes, so that the reset input 28 of flip-flop KS is connected. In this case flip-flop KS will not emit a pulse when the operating button 24 is actuated. The ability of the oscillator circuit to react immediately is thus ensured whenever window pane 4 has been moved either from the fully open or fully closed positions.

Many additional embodiments fall within the scope of the invention. It is, for example, possible to connect an electronic sensing circuit to the electric conductor which senses a change in resistance caused by a body representing a conductive connection to the chassis of the vehicle. Such a circuit can be designed from the usual components. This arrangement may be satisfactory, if no objection is made to the fact that it will only be activated if an electrically conductive contact is established before or at the time of the shut-off by a body part between window frame 2 and electric conductor 7 in the edge area 6. In certain cases it may be sufficient if the sensing circuit is designed, with means known per se, so that actuating button 24 forms a counterelectrode to electric conductor 7, which makes it possible to sense a conductive connection which may exist between the two electrodes on the basis of body contact on both sides.

It is also possible to make use in the sensing circuit of the electric capacity which becomes effective when a human body touches conductor 7, in order to switch off the drive unit.

What is claimed is:

1. Apparatus for arresting the motion of a motor driven panel when an object comes in contact with a leading edge of said panel comprising:

(a) an electrical conductor along said leading edge of said panel;

(b) means for sensing the presence of an object in contact with said electrical conductor;

(c) a switching means responsive to said sensing means for disconnecting or reversing power to said motor when an object is in contact with said conductor;

(d) a means for reversing polarity of the power supplied to said motor to reverse its direction, thus moving said panel either toward a first position or toward a second position;

(e) a conducting surface which contacts said panel when said panel is in said second position;

(f) an extension of said electrical conductor along the edge of said panel to a point where said conductor contacts said conducting surface when said panel moves to said second position, thereby actuating said sensing circuit and removing power from said motor;

(g) means for providing power of the proper polarity to said sensing means and said switching means when power of either polarity is selected; and (h) means for preventing said switching means from operating to disconnect power to said motor for a period of time after an application of power to said motor when said panel is in said second position, whereby said motor is actuated for a time interval sufficient to allow said panel to move from said second position.

2. The apparatus of claim 1 wherein said sensing circuit responds to a capacitance presented by said conductor.

3. The apparatus of claim 1 further comprising:

(a) a frame within which said panel moves, said frame having an edge parallel to said leading edge of said panel; and (b) means for preventing said apparatus from operating to disconnect power to said motor for a period of time after an application of power when said panel is in said first position whereby said motor is actuated for a time interval sufficient to allow the panel to move from said first position.

4. The apparatus of claim 1 further comprising at least one switch that is actuated when said panel is located away from one of its first or second positions, said switch disabling the operation of said delay circuit when said switch is actuated.

5. The apparatus of claim 1 wherein a diode is connected in a negative voltage lead to said sensing means and is poled so as to shift the minimum potential of said sensing means.

6. Apparatus for arresting the motion of a motor driven panel when an object comes in contact with a leading edge of said panel comprising:

(a) an electrical conductor along said leading edge of said panel;

(b) an oscillator for supplying an electrical excitation signal to said electrical conductor;

(c) means for sensing a reduction in amplitude of said electrical excitation signal from said oscillator when an object comes in contact with said electrical conductor; and (d) a switching means responsive to said sensing means for disconnecting or reversing power to said motor, wherein said excitation signal is supplied to said electrical conductor by means of a coaxial cable, a center conductor of said coaxial cable being excited by a high impedance signal and an outer conductor of said coaxial cable being excited by a low impedance signal of the same phase as said high impedance signal, whereby the capacity of said coaxial cable is compensated, rendering the apparatus insensitive to length or position of said coaxial cable.

7. The apparatus of claim 6 wherein the oscillator has a frequency of about 200 kHz.

8. The apparatus of claim 6 wherein the electrical conductor is connected to said oscillator by means of a center conductor of a coaxial cable.

9. The apparatus of claim 8 further comprising a voltage follower, an input of which is connected to said oscillator and an output of which is connected to an outer conductor of said coaxial cable.

10. The apparatus of claim 6 wherein the sensing means comprises:

(a) a first inverter stage with an input biased so that said inverter stage has a first output when said oscillator signal has an amplitude undiminished by the presence of an object in contact with said electrical conductor and a second output when said oscillator signal has an amplitude diminished by the presence of an object in contact with said electrical conductor;

(b) a diode through which a capacitor is charged by said first output of said inverter stage;

(c) a discharging resistor in parallel with said capacitor for discharging said capacitor when it is not charged through said diode; and (d) a second inverter stage responsive to a voltage produced across said capacitor.

11. The apparatus of claim 10 wherein the switching means comprises transistors configured as a Darlington amplifier wherein power to said motor is disconnected when current is caused to flow through the Darlington amplifier in response to an output signal from said second inverter stage produced when an object is in contact with said electrical conductor.

12. The apparatus of claim 6 further comprising:

(a) a means for reversing polarity of the power supplied to said motor to reverse its direction, thus moving said panel either toward a first position or a second position; and (b) a delay circuit for preventing said switching means from operating to disconnect power to said motor for a period of time after an application of power when said panel is in said first or said second position, whereby said motor is actuated for a time interval sufficient to allow said panel to move from said first or said second position.

13. Apparatus for arresting the motion of a motor driven panel when an object comes in contact with a leading edge of said panel comprising:

(a) an electrical conductor along said leading edge of said panel;

(b) means for sensing the presence of an object in contact with said electrical conductor;

(c) a switching means responsive to said sensing means for disconnecting or reversing power to said motor;

(d) means for reversing polarity of said power to change the direction of said motor and move said panel either in a first direction or in a second direction opposite to said first direction, whereby said panel is moved either toward a first position or toward a second position;

(e) means for disconnecting power from at least one of said sensing means and switching means when said panel is moved in one of said directions, whereby the operation of said switching means is prevented when the panel is moved in said one direction; and (f) a delay circuit for preventing said switching means from operating to disconnect power to said motor for a period of time after an application of power to said motor when said panel is in said first or said second position, whereby said motor is actuated for a time interval sufficient to move said panel from said first or said second position.

14. The apparatus of claim 1, 6 or 13 wherein the moving panel is an automotive vehicle window.

* * * * *